United States Patent [19]

Nicolaus

[11] 4,243,133

[45] Jan. 6, 1981

[54] ANTI-STRINGING DEVICE FOR A COIN DETECTING DEVICE

[75] Inventor: Frank G. Nicolaus, Chicago, Ill.

[73] Assignee: Bally Manufacturing Corporation, Chicago, Ill.

[21] Appl. No.: 18,751

[22] Filed: Mar. 8, 1979

[51] Int. Cl.[3] ..... G07F 1/04

[52] U.S. Cl. ..... 194/9 R; 194/97 R; 194/97 B

[58] Field of Search ..... 194/97 R, 97 B, 9 R, 194/1 E

[56] References Cited

U.S. PATENT DOCUMENTS

| | | | |
|---|---|---|---|
| 3,279,574 | 10/1966 | Seiden | 194/97 R X |
| 3,627,094 | 12/1971 | Kaufman et al. | 194/97 R |
| 3,998,309 | 12/1976 | Mandas et al. | 194/97 R |

FOREIGN PATENT DOCUMENTS

| | | | |
|---|---|---|---|
| 1525886 | 9/1978 | United Kingdom | 194/97 B |

*Primary Examiner*—F. J. Bartuska

*Attorney, Agent, or Firm*—Fitch, Even, Tabin, Flannery & Welsh

[57] ABSTRACT

A coin detecting device is described comprising a coin chute of the gravity type defining a path down which a coin travels, a delayed-reset microswitch having an actuating arm which is tripped by the passage of the coin down the path, and a plurality of unidirectional coin passing gates located along the path for preventing a cheating operation known as stringing. Stringing involves dropping a coin with a string attached past such a detecting device and manipulating the coin with the string in a manner to make it appear that several coins have passed. The coin detecting device is effective in preventing stringing with coins having slotted and unslotted bodies.

12 Claims, 6 Drawing Figures

ANTI-STRINGING DEVICE FOR A COIN DETECTING DEVICE

This invention relates to a coin detecting device, and, more particularly, to a coin detecting device which prevents the cheating procedure commonly known as "stringing."

Gaming devices such as slot machines incorporate a device commonly known as a coin acceptor which detects and signals the insertion into the device of a proper coin for activation of the gaming device. Such coin acceptors usually perform several functions. In the first instance, the coin acceptor conducts various tests on the coin inserted into the machine to detect whether a proper coin is being offered for activation of the device. Such a coin acceptor usually operates to reject any coin not meeting all the tests, i.e., the rejected coin is deflected and caused to travel down a different path for return to the owner instead of traveling down an accepted coin path with the owner being credited for paying that amount. Gaming devices which contain apparatus to perform these various functions are disclosed in U.S. Pat. Nos. 3,279,574, 3,627,094 and 3,998,309.

After passing the above identified tests, a coin traveling down the accepted coin path usually is passed by a coin detecting device which detects the passage of an accepted coin and activates the machine. The coin detecting device usually comprises a microswitch having an actuating arm which is tripped by the passage of a coin down the accepted coin path.

There has arisen a method of cheating the coin acceptor which utilize coin detecting devices of the type described above commonly referred to as stringing. Generally, stringing comprises the procedure of fastening to a suitable coin a string or thread that is lightweight and has no noticeable affect on the passage of the coin down the coin acceptor. The coin acceptor will pass the coin down the accepted coin path because the coin is suitable for acceptance and meets all the tests. In the stringing procedure, once the coin has passed down the accepted coin path a sufficient distance to trip the microswitch, it is moved back past the switch trip mechanism by pulling on the string a very short distance and then is allowed to pass once again past the actuating arm. Thus, the coin detecting device indicates the passage of several suitable coins past the actuating arm when in fact only one suitable coin has been inserted and is being held in the coin detector.

A variety of devices have been disclosed to prevent the cheating procedure known as stringing. These include electronic sensing devices for indicating the uninterrupted passage of coins by various sensors located along the path of the coin. However, these electronic devices are expensive and difficult to maintain. Other devices which have been disclosed to prevent stringing also include mechanical devices such as cut off knives located at critical points along the coin path, and a variety of snaring and tripping instrumentalities. However, these mechanical devices have been effective only to a limited degree.

A particular mechanical device for preventing stringing is disclosed in the above mentioned U.S. Pat. No. 3,627,094 which discloses the use of a single unidirectional coin gate. The unidirectional coin gate allows a coin traveling down the accepted coin path to pass the gate and activate the switch, but prevents the coin from being fraudulently drawn up the path and thus prevents repeated actuation of the switch by a single coin.

There has arisen a variation of the method of stringing for defeating the fraud preventing device which contains a single unidirectional coin gate of the above described type. By using an otherwise acceptable coin with a slot cut in its body, the coin can be fraudulently pulled up the path around the single unidirectional coin gate a distance sufficient to allow the microswitch to reset, thus defeating the unidirectional coin gate.

Accordingly, it is an object of the present invention to provide an improved coin detecting device which prevents the cheating procedure commonly known as stringing.

More particularly stated, it is an object of the present invention to provide an improved coin detecting device which prevents stringing with coins having both slotted and unslotted bodies.

Other objects of the invention in addition to those set forth above will become apparent to those skilled in the arts from the following description, taken in connection with the accompanying drawings, wherein.

Figure 1:
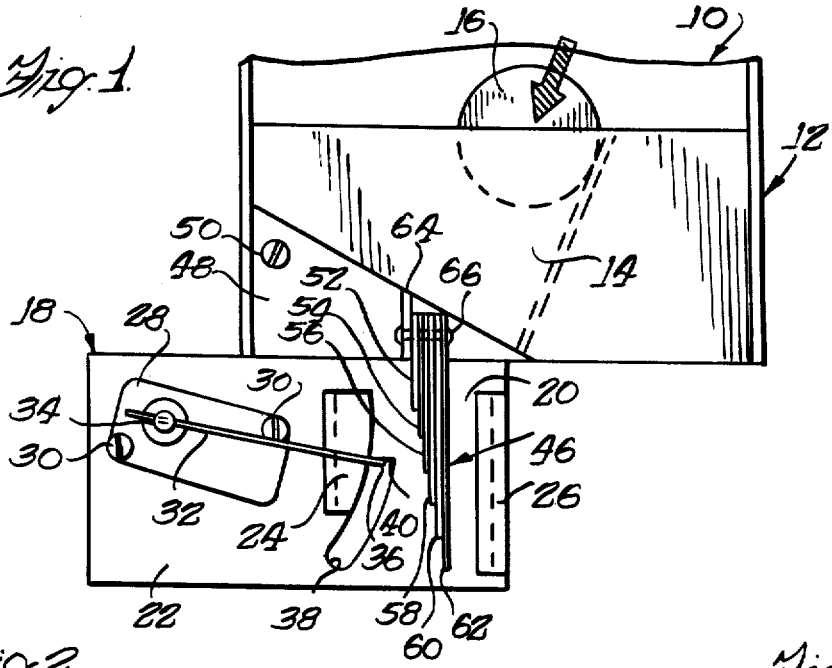
FIG. 1 is a partially broken away side view of a device constructed in accordance with the invention, attached to the bottom of a coin chute.

Very generally, the illustrated embodiment of the present invention comprises a coin chute which defines a path down which a coin travels. A switch having first and second electrical states is attached to the coin chute and actuating means are connected to the switch for changing the electrical state of the switch. The actuating means changes the switch to the first electrical state when the bottom edge of a coin traveling down the path passes a predetermined first position along the path, and changes the switch to the second electrical state when either the bottom edge of a coin traveling down the path passes a predetermined distance past the first position or the bottom edge of a coin which had past the first position is pulled up the path passes a predetermined second position along the path. Further, gating means are provided for preventing a coin with a slotted body from being drawn up the path far enough to allow the switch to change to the second electrical state after its bottom edge had passed the second position along the path and had forced the switching means into its first electrical state. The gating means thereby protects against fraudulent repetitious manipulation sufficient to effect more than one actuation of the switch.

Referring more particularly to the drawings, there is shown coin acceptor device 10 of the gravity type which can be used with any number of gaming devices. The coin acceptor device 10 comprises a coin chute 12 of which only the bottom portion is shown. The coin chute 12 defines a path 14 down which a coin 16 travels.

As noted above, the coin chute 12 may include any number of testing apparatus to determine the acceptability of the coin 16.

Attached to the bottom of the coin chute 12 is a coin chute 18. The coin chute 18 comprises a main bracket 22 and two side brackets 24 and 26 which are secured to the main bracket 22. Together the main bracket 22 and the side brackets 24 and 26 define a path 20 down which the coin 16 also travels.

The switch 28 is securely screwed to the main bracket 22 by two screws 30. An actuating arm 32 is secured at one side to a pivotal actuating post 34 of the switch 28 for joint rotation about the axis of the post 34. The actuating arm 32 is spring loaded in a rest position as seen in FIG. 1 with a distal portion 36 located directly across the path 20. A coin traveling down the path 20 will come in contact with and pivot the actuating arm 32 in the general direction of travel of the coin 16. The distal portion 36 of the actuating arm 32 extends through a slot 38 in the main bracket 22. The slot 38 is shaped to allow the distal portion 36 to swing uninterruptedly about the post 34. A top edge 40 of the slot 36 acts as a stop, defining the rest position of the actuating arm 32.

The switch 28 is positioned so that when free falling the coin 16 drops from the coin chute 12 into the coin chute 18, the bottom edge of the coin 16 comes in contact with the distal portion 36 of the actuating arm 32 and pivots the actuating arm 32 about the axis of the post 34. As the coin 16 nears the exit of the path 20 of the coin chute 18, the actuating arm 32 disengages from the coin 16 and returns to the rest position. The progression of the coin 16 dropping down the paths 14 and 20 of the coin chutes 12 and 18 is shown respectfully in FIGS. 1 thru 3.

The switch 28 is a two state microswitch with a delayed reset. The definition of these two states depends upon the type of circuitry in which the switch 28 is connected. The circuitry, although not shown in the figures, is actuated by the switch 28 to indicate that an acceptable coin has passed through the coin acceptor device 10. In the embodiment illustrated in the figures, the first state is a closed circuit state and the second state is an open circuit state.

Figure 2:
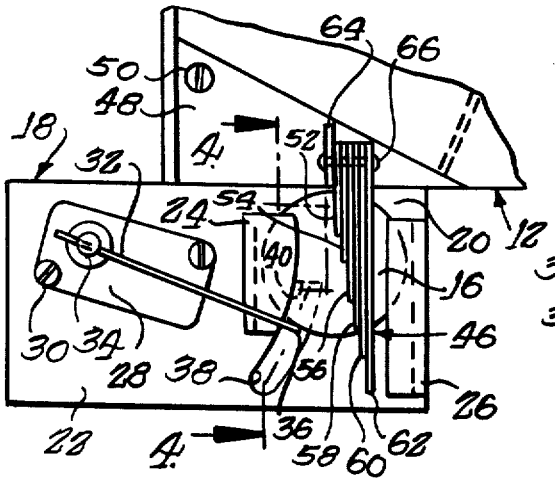
FIG. 2 is also a partially broken away side view of the device of FIG. 1 showing a further progression of a coin down the device.
Figure 4:
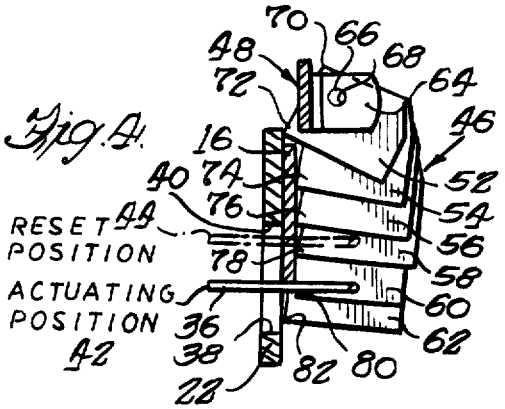
FIg. 4 is a sectional view generally taken along the line 4—4 in FIG. 2 showing the interaction of the coin with the device in more detail.

As noted before, the switch 28 is spring loaded to return to a rest position. In the rest position the switch 28 is in the second state. The switch 28 changes to the first state when the distal portion 36 of the actuating arm 32 swings down the path 20 past a predetermined first or actuating position 42, as shown in FIGS. 2 and 4. The switch 28 remains in the first state, returning to the second state only when the distal portion 36 of the actuating arm 32 swings up path 20 past a predetermined second or reset position 44, as shown in FIG. 4.

It is noted that switch 28 has a delayed reset, i.e., its actuating position 42 and reset position 44 are not contingent. The reset position 44 is located further up the path 20 than the actuating position 42. The distance between the actuating position 42 and the reset position 44, as can clearly be seen in FIG. 4, is defined as the delay distance.

In keeping with the invention, a gating means 46 comprises a bracket 48 which is attached to the bottom of the coin chute 12 by a screw 50. Pawsl 52, 54, 56, 58, 60 and 62 are pivotally hung side-by-side from a protruding distal portion 64 of the bracket 48 by a pin 66. The pawls all hang perpendicular to the plane of the main bracket 22. Each of the pawls is similar in construction except for their lengths. Therefore, only the construction of the pawl 52 will be detailed.

The pawl 52 is a piece of thin metal generally rectangular in shape having a hole 68 located at an upper corner 70 which is adjacent to the coin chute 18. The pawl 52 is pivotally hung from a pin 66 in a hole 68. By locating the hole 68 off-center, the pawl 52 is counterbalanced so that in the normal position a bottom corner 72 of the pawl 52 which is adjacent to the coin chute 18 contacts and rests against the main bracket 22. It is noted that the pawl 52 is hung so that the point of contact of the bottom corner 72 with the main bracket 22 is located near the center of the path 20.

The pawls 54, 56, 58, 60 and 62 are all identically shaped to the pawl 52, except, as noted above, each is progressively longer in length. They are also hung from the pin 66 identically to the pawl 52. Therefore, the points of contact of the bottom corners 72, 74, 76, 78, 80 and 82 of the pawls 52, 54, 56, 58, 60 and 62 respectively against the main bracket 22 are evenly spaced down the path 20.

It is noted that the thickness of the pawls had been exaggerated in the drawings for illustration purposes. In the illustrated embodiment the pawls are 0.15 inches thick. Also, although not shown in the figures, each pawl contains a spot indentation to reduce the friction between the pawls.

By hanging the pawls in the manner described above, each pawl acts as a unidirectional coin passing gate which only allows the edge of a coin to pass if the coin is traveling down the coin chute. More specifically, the bottom edge of a coin traveling down the path 20 moves the bottom corner of the pawl from its contacting point with the main bracket 22 and slides unobstructedly past the pawl. As the coin passes, the bottom corner of the pawl slides along the outer face of the coin. Since the pawl is counterbalanced as described above, when the top edge of the coin passes the bottom corner of the pawl, the pawl swings back in contact with the main bracket 22. In this way the top edge of a coin fraudulently forced up the path 20 contacts and is restricted by the bottom corner of the pawl.

Figure 3:
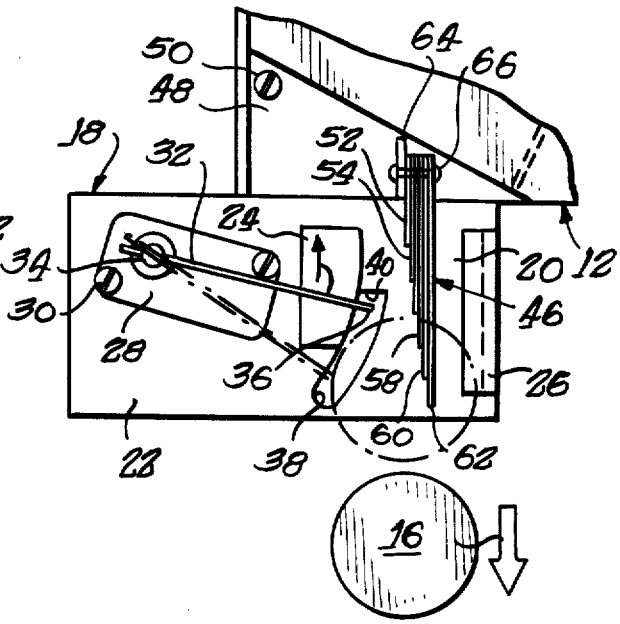
FIG. 3 is also a partially broken away side view of the device of FIG. 1 showing still a further progression of the coin down the device.

Referring to FIGS. 2 and 3, it can be seen that a coin traveling down the coin chute moves each of the pawls that it comes in contact with and slides unobstructedly down the path 20.

Referring specifically to FIG. 4, there can be seen the coin 16 which has dropped down to the actuating position 42 along the path 20. The pawls 54, 56, 58 and 60 have been moved from the main bracket 22 by the coin 16 and therefore are shown riding along the outer surface of the coin 16. The coin 16 has not contacted the pawl 62 and therefore the bottom corner 82 of the pawl 62 is still in contact with the main bracket 22. It can also be seen in FIG. 4 that the coin 16 has passed the position along the path 20 where the bottom corner 72 of the pawl 52 comes in contact with the main bracket 22. Therefore, the bottom corner 72 has swung back toward and made contact with the main bracket 22. It can be seen that any attempt to pull the coin up the path 20 would force the top edge of the coin 16 into contact with the pawl 52 which would prevent it from being pulled further up the path 20.

It is to be noted that to prevent multiple actuation of the switch 28 by a single coin, the top pawl must be located along the path 20 so that the top edge of the coin 16 must totally pass the top pawl 52 before it forces the actuating arm 32 past the actuating position 42. In other words, the distance between the point that the contacting edge 72 of the pawl 52 comes in contact with the main bracket 22 and the actuating position 42, must be slightly greater than the diameter of the coin 16. In this way, before a coin can actuate the switch 28 it must totally pass at least one pawl. This design prevents the coin 16 from being forced up the path 20 far enough to allow the actuating arm to reach the reset position and thereby fraudulently effectuate more than one actuation of the gaming device.

Referring to FIGS. 2 and 4, there is shown a coin traveling down the path 20 which has engaged and swung the actuating arm 32 to the actuating position 42. As noted above, it can be seen that the bottom corner 72 of the pawl 52 has swung shut and is contacting the main bracket 22. This prevents the coin 16 from being pulled up the path 20, thereby preventing the fraudulent operation commonly known as stringing.

As noted above, a method of defeating gating means comprising only a single gate has been devised. It is accomplished by cutting slots of various sizes and shapes in the body of otherwise acceptable coins which allow the coins to be pulled up the path a distance sufficient to defeat a single coin gate and allow the switch to be reset. To overcome this problem, the device of the invention has been designed, as described above, with a plurality of coin passing gates, or pawls, evenly spaced along the center of the path of the coin chute. These coin passing gates, or pawls, are situated along the path 20 to prevent the fraudulent repeated actuation of the switch 28 by a single coin having a slot cut out of it.

Figure 5:
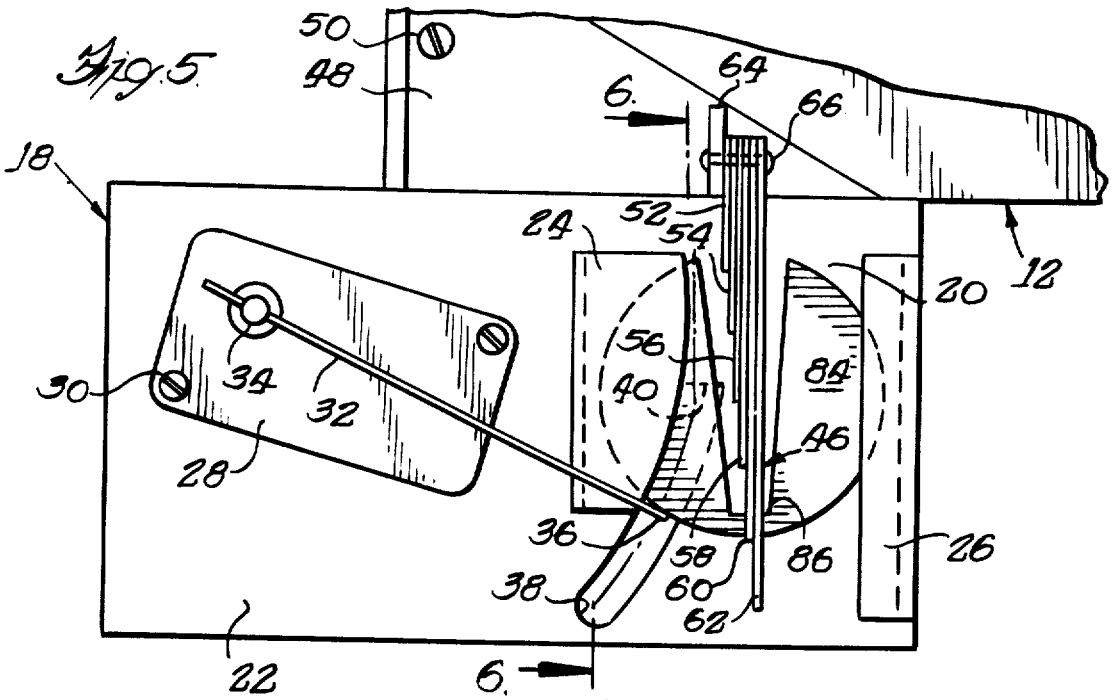
FIG. 5 is an enlargement of FIG. 3 showing the interaction of the device with a slotted coin.
Figure 6:
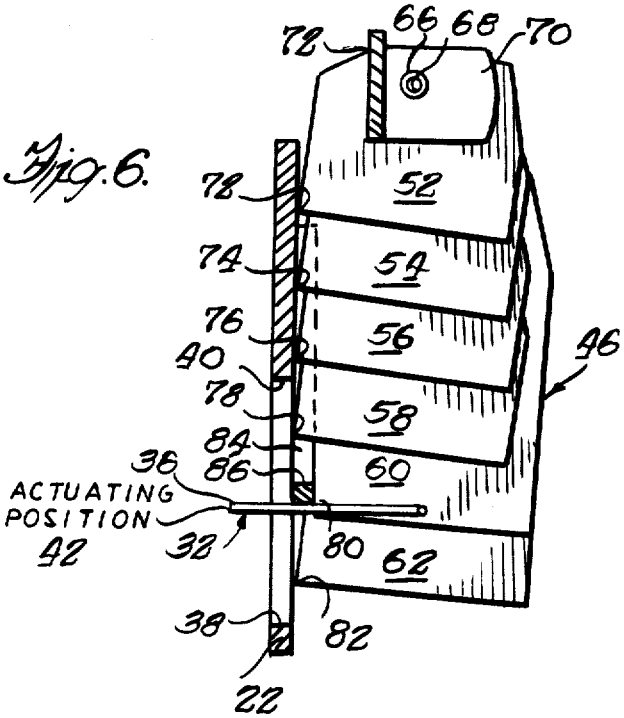
FIG. 6 is a sectional view taken generally along the line 6—6 in FIG. 5 showing the interaction of the device with the slotted coin in more detail.

Referring to FIGS. 5 and 6, there is shown a slotted coin 84 traveling down the path 20 with the bottom edge at the actuating position 42. As particularly shown in FIG. 6, the top edge 86 of the coin has passed the pawls 52, 54, 56 and 58. The pawls 52, 54, 56 and 58 are therefore closed and prevent the coin 84 from being pulled back up the path 20 a distance sufficient to reset the switch 28. The fraudulent operation known as stringing with a slotted coin is thereby prevented.

As noted before, the delay distance is the distance between the actuating position and the reset position. To insure that a coin having a slot of any length cannot be used for more than one actuation of the switch 28, the delay distance must be sufficiently greater than the distance between the points at which the bottom corners of adjacent pawls contact the main bracket 22. Further, sufficient pawls must be used so that the bottom edge of the pawl which contacts the main bracket 22 the furthest distance down the path 20, i.e., the edge 82 of the pawl 62, is below the actuating position along the path. In this way it is insured that a coin having a slot of any size or shape which has actuated the switch 28 cannot be pulled back up the path 20 a distance sufficient to allow the switch 28 to reset. Therefore, the device of the invention prevents the fraudulent operation commonly called stringing with either slotted or unslotted coins.

It is noted that although not shown in the figures, slight recesses may be provided in the main bracket 22 located at the points of contact between the pawls and the main bracket 22 for preventing movement transversal to the pivotal movement of the pawls as the pawls contact the main bracket 22. This increases the chance that the pawl will catch on the slotted top edge of the coin 16.

However, although the coin passing gates of the illustrated embodiment comprise a plurality of thin pawls this disclosure is intended to include any coin passing gate which would perform the same function as the pawls described above. That is, to prevent the coin 16 having a slotted body from being forced up path 20 a distance sufficient to allow switch 28 to reset once it has actuated.

It may therefore be seen that the invention provides an improved coin accepting device which prevents the cheating operation commonly known as stringing. The device of the invention can prevent stringing with coins having both slotted and unslotted bodies.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

Various features of the invention are set forth in the following claims.

What is claimed is:

1. A coin detecting device comprising: a coin chute defining a path down which a coin travels; a switch having first and second electrical states; actuating means connected to the switch for changing the electrical state of the switch, the actuating means changing the switch to the first electrical state when a coin traveling down the path passes a predetermined first position along the path, and changing the switch to the second electrical state when either a coin traveling down the path passes a predetermined distance past the first position or a coin which had past the first position is pulled up the path past a predetermined second position along the path; and gating means comprising a plurality of independently movable coin passing gates situated along the path for preventing a coin with a slotted body from being drawn up the path far enough to allow the switch to change to the second electrical state after it had passed the first position along the path and had forced the switch into its first electrical state, thus protecting against multiple actuation of the switch by one coin.

2. The coin detecting device of claim 1 wherein the switch has a delayed reset and wherein the reset distance is greater than the distance along the path between any two adjacent ones of the plurality of coin passing gates.

3. The coin detecting device of claim 2 wherein the actuating means change the switch to the first electrical state when a bottom edge of a coin traveling down the path passes the first position along the path, and the actuating means change the switch to the second electrical state when either the bottom edge of a coin traveling down the path passes a predetermined distance past the first position or the bottom edge of a coin which had past the first position is pulled up the path past the second position along the path.

4. The coin detecting device of claim 3 wherein each of the coin passing gates allows the bottom edge of a coin traveling down the path to pass, and does not allow the top edge of a coin traveling up the path to pass.

5. The coin detecting device of claim 4 wherein the actuating means further comprises an actuating arm connected to the switch, a distal portion of the actuating arm being positioned in the path to be engaged and moved by the bottom edge of the coin traveling down the path.

6. The coin detecting device of claim 5 wherein the actuating arm is biased to return to a rest position, in the rest position the distal portion of the actuating arm is located higher up the path than the second position.

7. The coin detecting device of claim 6 wherein the actuating arm is pivotal.

8. The coin detecting device of claim 7 wherein a coin traveling down the path first contacts the actuating arm in the rest position, forces the actuating arm down the path past the second position, and then past the first position.

9. The coin detecting device of claim 2 or claim 3 wherein each of the coin passing gates is a pawl.

10. The coin detecting device of claim 9 wherein each of the pawls has a corner which rides against the coin chute in the path.

11. The coin detecting device of claim 10 wherein each of the pawls is pivotal and contains biasing means for forcing the corner of each of the pawls against the coin chute.

12. The coin detecting device of claim 11 wherein each of the biasing means comprises a counter-balancing portion of each of the pawls so distributed to cause the corner of each of said pawls to pivot toward and rest against the coin chute in the path.

* * * * *